US006726603B1

(12) United States Patent
Beaute et al.

(10) Patent No.: US 6,726,603 B1
(45) Date of Patent: Apr. 27, 2004

(54) APPARATUS FOR JUMPING BY SUCCESSIVE LEAPS

(76) Inventors: Jean-Charles Beaute, "Villa Beauty" Lot. C3, Parc de la Baie Orientale 97150 Saint-Martin Guadeloupe (FR), 97150; Jean-Louis Bourdaries, Rue de la Brunaude, 81800 Couffouleux (FR), F-81800; Eric Beaute, 1, Rue Flandres Dunkerque "Casa 39.A", La Pleta d'Ordino Ordino Prinicpality of Andorra (FR)

( * ) Notice: Subject to any disclaimer, the term of this patent is extended or adjusted under 35 U.S.C. 154(b) by 179 days.

(21) Appl. No.: 10/030,550

(22) PCT Filed: Jun. 23, 2000

(86) PCT No.: PCT/FR00/01756

§ 371 (c)(1),
(2), (4) Date: Jan. 11, 2002

(87) PCT Pub. No.: WO01/03778

PCT Pub. Date: Jan. 18, 2001

(30) Foreign Application Priority Data

Jul. 13, 1999 (FR) ..... 99 09076

(51) Int. Cl.[7] ..... A63B 25/08
(52) U.S. Cl. ..... 482/77
(58) Field of Search ..... 280/276, 277; 482/25–77; D21/413

(56) References Cited

U.S. PATENT DOCUMENTS

| | | | | |
|---|---|---|---|---|
| 2,992,009 A | * | 7/1961 | Dimitriadis | 280/1.13 |
| 3,432,162 A | * | 3/1969 | Flemming | 482/77 |
| 3,773,320 A | | 11/1973 | Samiran et al. | |
| 3,853,195 A | | 12/1974 | Rasanen | |
| 4,390,178 A | * | 6/1983 | Rudell et al. | 482/77 |
| 4,625,985 A | * | 12/1986 | Nakano et al. | 280/276 |
| 4,828,251 A | * | 5/1989 | Schreiber | 482/77 |
| 4,971,344 A | * | 11/1990 | Turner | 280/276 |
| 5,193,833 A | * | 3/1993 | Reisinger | 280/276 |

* cited by examiner

*Primary Examiner*—Nicholas D. Lucchesi
*Assistant Examiner*—Fenn C Mathew
(74) *Attorney, Agent, or Firm*—Young & Thompson

(57) ABSTRACT

A device (1) for performing jumps by successive leaps, includes a tubular body (2) which is provided at one of its ends, referred to as the "lower" end, with footrest struts (3, 4); a handlebar (8) equipped with grips (81, 82) which is integral with the other end, referred to as the "upper" end, of the body; an impact shaft (5) is adapted to slide inside the body (2) and at least part of which is capable of being deployed in the extension of the lower end of the body; and elements (14) for returning the shaft (5) elastically to an extreme deployed position. The device includes elements (9) for braking the impact shaft (5) in relation to the body (2) and elements (83, 84), which are disposed on the handlebar (8), for manually controlling the braking elements(9).

15 Claims, 5 Drawing Sheets

APPARATUS FOR JUMPING BY SUCCESSIVE LEAPS

FIELD OF THE INVENTION

The present invention relates to a device for performing jumps by successive leaps.

BACKGROUND OF THE INVENTION

The type of device aimed at by the invention has, to a great extent, already been described in numerous publications, such as U.S. Pat. No. 4,390,178.

This patent describes a machine essentially comprising a tube inside which there slides an impact shaft, the deployment of which towards the ground is effected by means of a compression spring. The improvement made to this machine resides in the fact that the handlebar with grips and the footrest struts, which are fixed to the upper and lower ends of the tube respectively by means of a pin, are capable of pivoting about the axis of the tube and are interconnected via rigid metal rods. A configuration of this kind makes it possible to keep the handlebars and the struts in the almost horizontal position, whatever the inclination imparted to the impact shaft.

In this way, the user has better control of his machine on uneven ground. However, the inexperienced user cannot familiarise himself with a machine of this kind in complete safety.

SUMMARY OF THE INVENTION

The object of the invention is to remedy this drawback and to propose a jumping machine of the above mentioned type which enables an inexperienced user to familiarise himself with the said machine in complete safety.

Another objective of the invention is to provide a jumping machine which can be used in extreme conditions such as those of a sporting competition.

To that end, the subject of the invention is a device for performing jumps by successive leaps which comprises:

- a tubular body which is provided at one of its ends, which is referred to as the "lower" end, with footrest struts,
- a handlebar equipped with grips which is integral with the other end, which is referred to as the "upper" end, of the body,
- an impact shaft which is adapted to slide inside the body and at least part of which is capable of being deployed in the extension of the lower end of the body, and means for returning the shaft elastically to an extreme deployed position.

According to the invention, the device is characterized by the fact that it comprises means for braking the impact shaft in relation to the body and means, which are disposed on the handlebar, for manually controlling the said braking means.

An inexperienced user can thus master the jumping device more easily with the aid of the braking means according to the invention, and therefore perform the initial jumps in complete safety.

Moreover, the device according to the invention can be used in extreme conditions, since the braking means are capable of instantaneously stopping the sliding of the impact shaft in relation to the body.

The footrest struts are preferably produced in a single, machined piece provided with an axial passage which is adapted to receive the impact shaft by sliding, the said machined piece being screwed to the lower end of the tubular body.

The handlebar is advantageously connected to the upper end of the body via a stem.

According to a preferred characteristic of the invention, the elastic returning means comprise a helicoidal spring.

The braking means advantageously comprise at least one friction surface which is adapted to rest radially against the shaft.

According to a preferred variant of the invention, the shaft is hollow and the friction surface rubs on the inside of the said shaft.

According to this variant, the friction surface is advantageously a cylindrical ring made of elastomer.

According to this variant again, the braking means comprise a bush which is adapted to deform the cylindrical ring radially.

According to the invention, the bush advantageously has, in its lower part, feet which each have an inclined face and are disposed in a concentric manner and around which the cylindrical ring is force-fitted. A needle having a conical head is preferably inserted between the feet, thereby coming into contact with each inclined face, the manual control means being adapted to displace the said needle axially with a view to causing the said feet to move apart radially.

Preferably again, the device comprises means for returning the needle elastically.

According to a preferred mode of embodiment of the invention, the device comprises a sleeve which is screwed to the upper end of the tubular body and extends longitudinally inside the latter in such a way as to accommodate the cables fixed to the braking means.

According to this mode of embodiment, the braking means are preferably fixed to the lower end of the sleeve.

The device according to the invention advantageously comprises a ball-socket which is adapted to guide the shaft along the axis of the body when it slides inside the

BRIEF DESCRIPTION OF THE DRAWING

Other advantageous characteristics of the invention will emerge below on reading the detailed description which is given with reference to FIGS. 1 to 3, of which, respectively.

DETAIL DESCRIPTION OF THE PREFERRED EMBODIMENT

Figure 1:
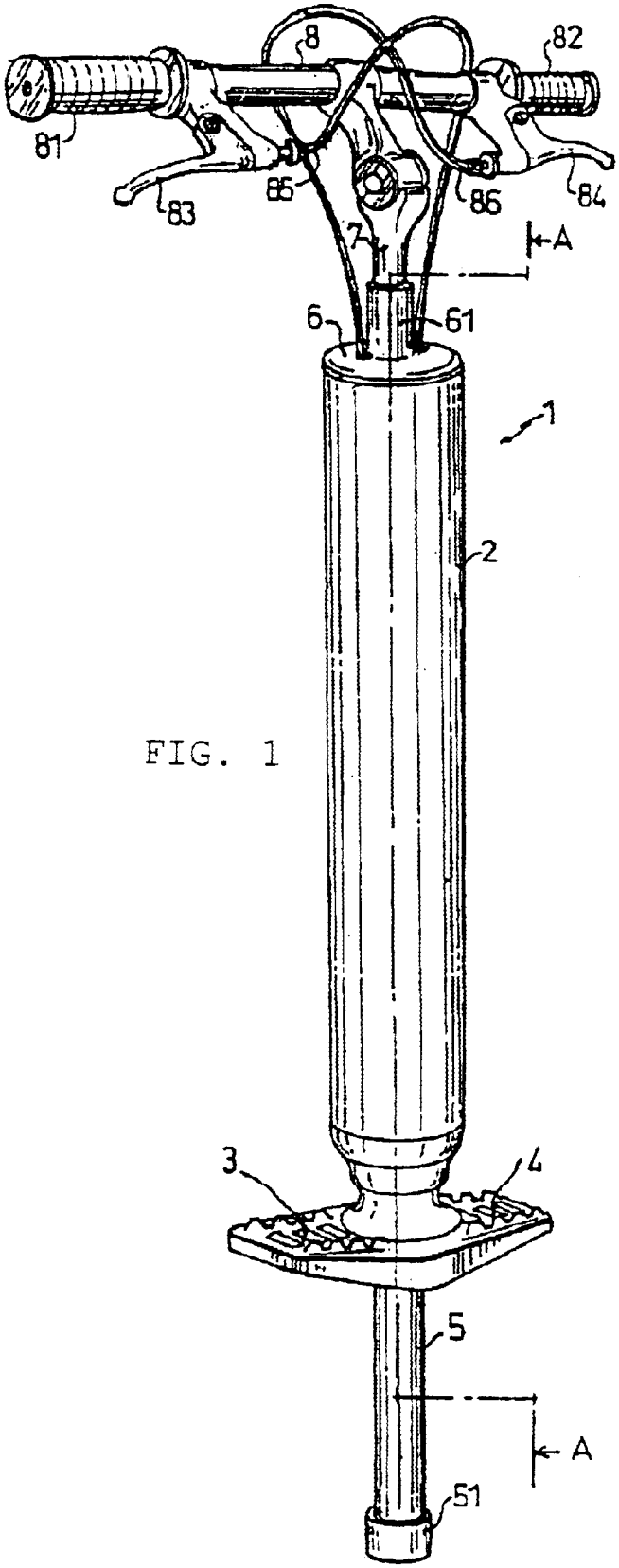
FIG. 1 represents a general view in perspective of a mode of embodiment of a device according to the invention.
Figure 2:
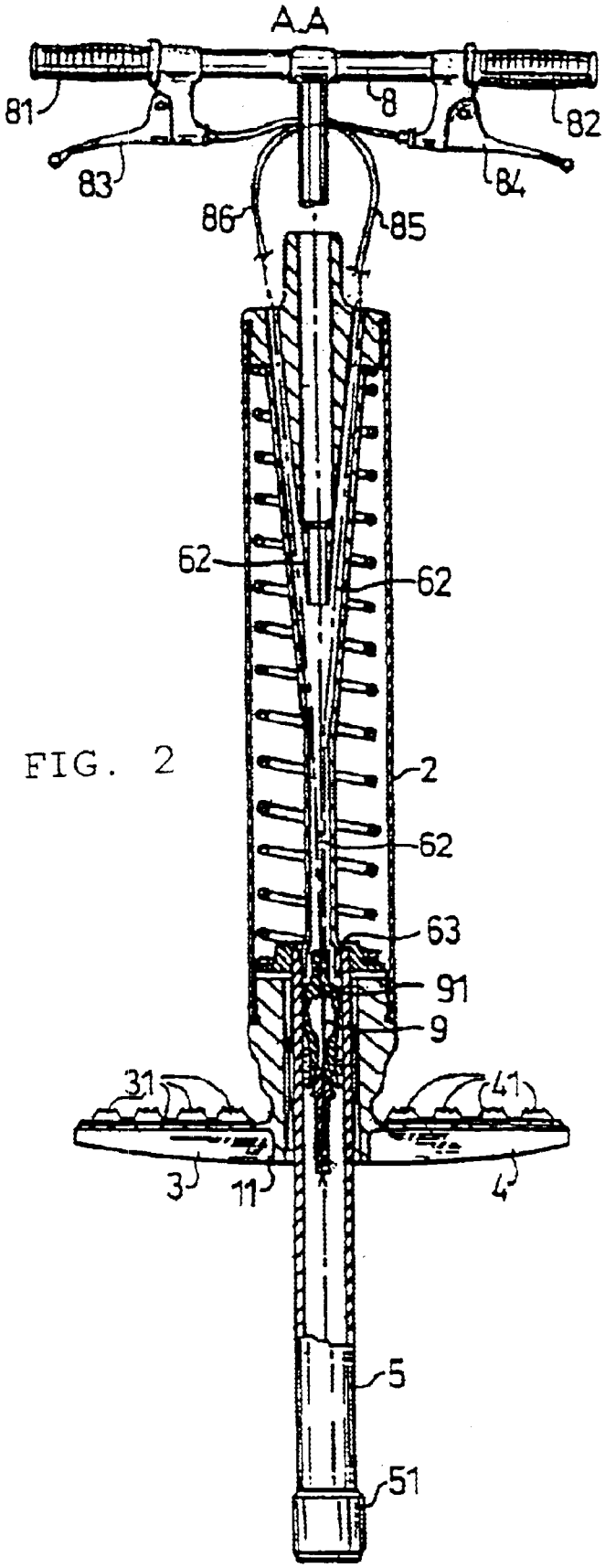
FIG. 2 represents a view in longitudinal section of the device in FIG. 1 along the axis A—A.
Figure 2A:
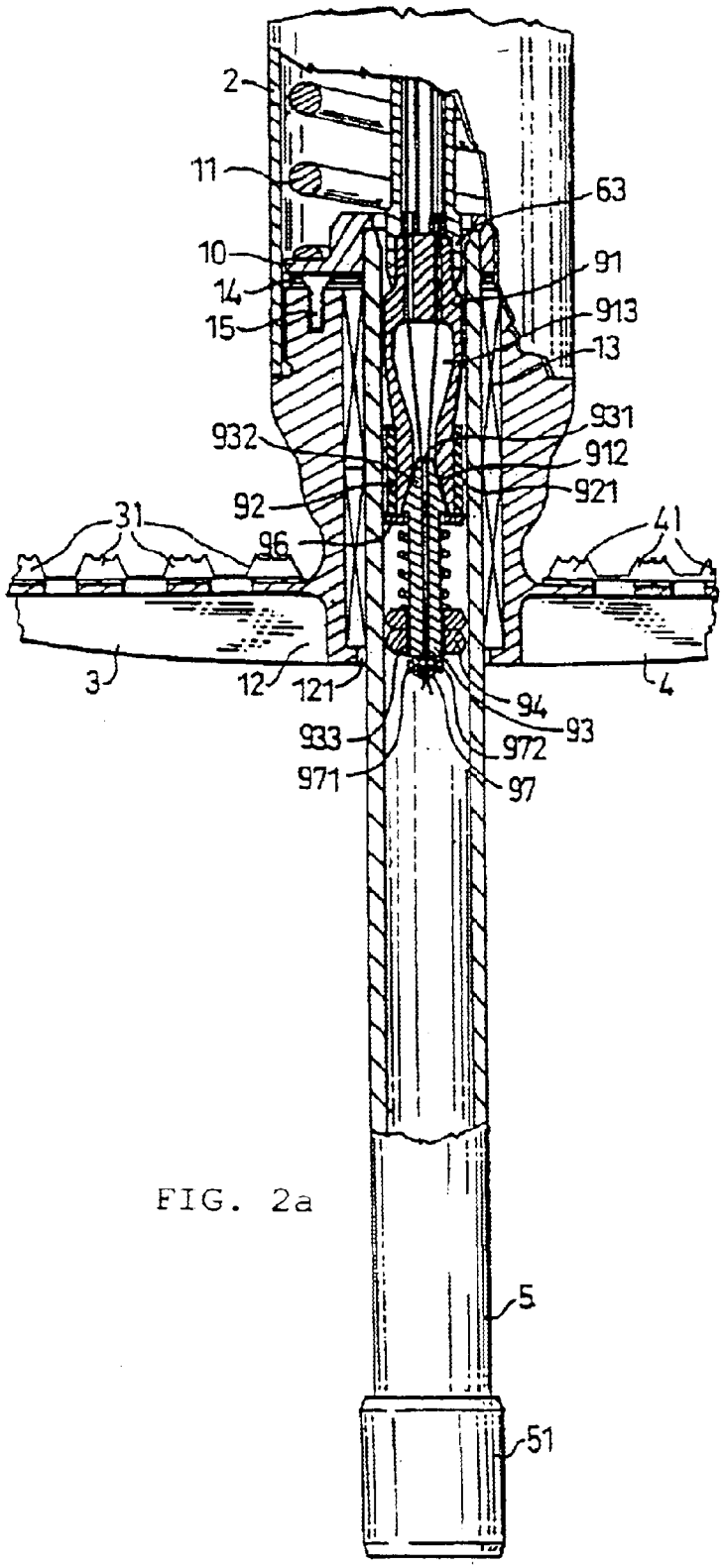
FIGS. 2*a* and 2*b* represent enlarged views of FIG. 2, explaining the functioning of part of the device.
Figure 2B:
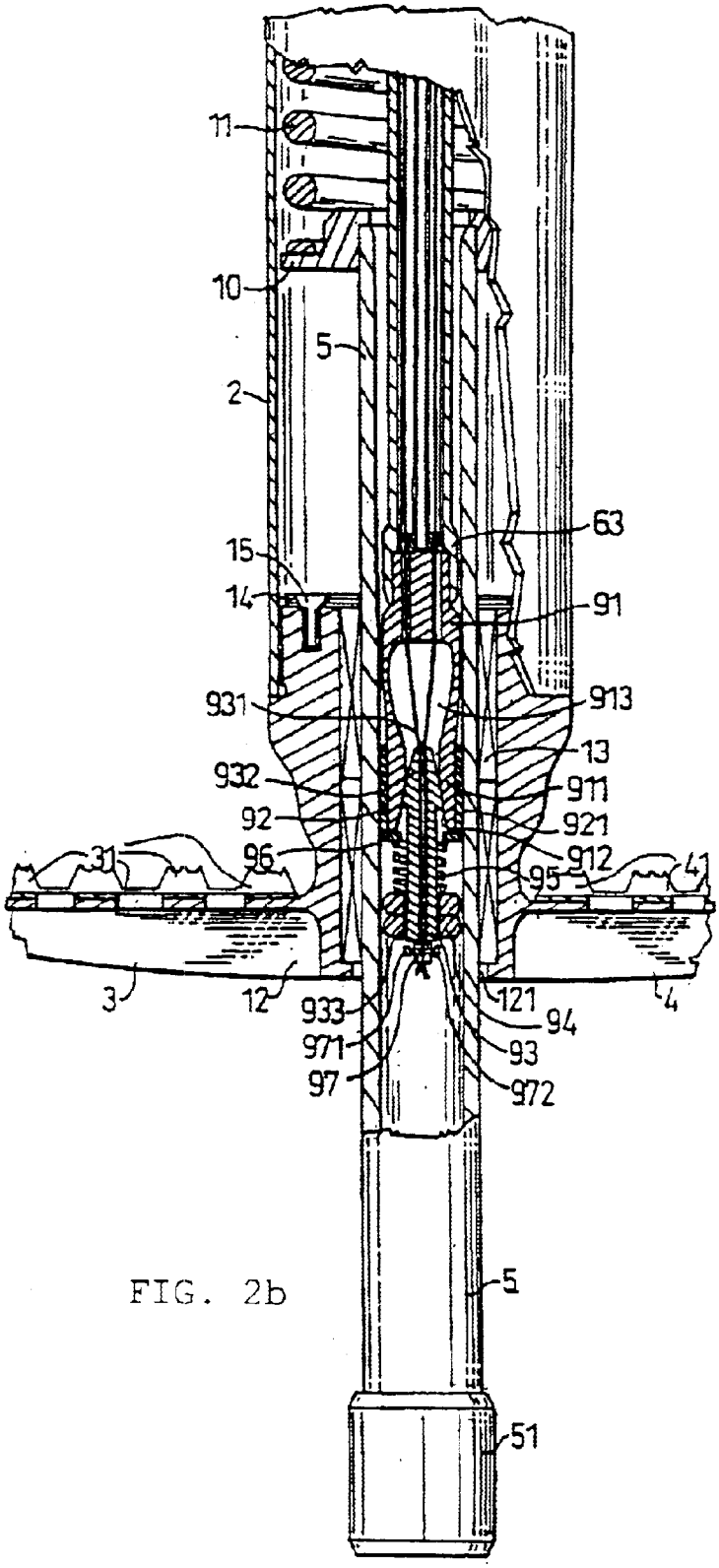

The device represented by way of an example in FIGS. 1 to 2*b* is intended for performing jumps by successive leaps and has been designed especially for users who wish to pursue a sport which reconciles a sense of balance and physical endurance.

As is represented in FIG. 1, this device 1 essentially comprises a tubular body 2 whose lower end is provided with two footrest struts 3, 4 and in the extension of which an impact shaft 5 is capable of being deployed downwards.

In its lower part, this impact shaft 5, which is adapted to slide inside the tubular body 2, has a base 51 made of a material with a low coefficient of friction.

A sleeve 6 is fixed to the tubular body 2 at the upper end of the latter. This sleeve 6 has a mouthpiece 61 in which there is accommodated a stem 7 of the type used for equipping bicycles designated by the term "mountain bikes".

A handlebar 8 provided with two grips 81, 82 is fixed to the said stem 7 in such a way that it extends transversely to the tubular body 2.

A lever 83, 84 is mounted, in a manner known per se, on each grip 81, 82. Fixed to each lever 83, 84 is a cable 85, 86 which is provided with a sheath and connected to braking means 9, which will be described in detail below.

FIG. 2 is a view in longitudinal section of the device in FIG. 1 along the axis A—A.

The tubular body 2 has a tapping 21, 22 at each of its ends.

The impact shaft 5 is hollow and has a force-fitted metal collar 10 at its upper end. This metal collar 10 rests against the lower part of a helicoidal spring 11. This compression spring 11 is adapted to bring the impact shaft 5 back to an extreme deployed position. Moreover, the characteristic dimensions of this spring 11 have been determined so as to avoid any contact between the lower part of the footrest struts 3, 4 and the base 51, even in extreme conditions of use. It should be noted that this spring 11 is interchangeable in accordance with the user's weight.

The footrest struts 3, 4 are perforated and are each provided with studs 31, 41 on their upper face. These struts 3, 4 are produced in a single machined piece 12 made of a light material such as aluminium. This machined piece 12 is provided with an axial passage 121 adapted to receive the impact shaft 5 by sliding, and is screwed to the lower end of the tubular body 2.

A ball-socket 13, which is adapted to guide the impact shaft 5 along the axis of the body 2 when it slides inside the latter, is accommodated inside the axial passage 121.

This ball-socket 13 is held in place in its seating via a small annular plate 14 which is fixed to the machined.piece 12 by means of screws 15.

At its lower end, the sleeve 6 has an enlarged portion 63 which is adapted to accommodate a cylindrical bush 91 which constitutes part of the braking means 9 according to the invention (FIG. 2*a*).

In its lower part, the bush 91 has feet 911 each having an inclined face 912 and disposed in a concentric manner, so that they form a cavity 913 having a symmetry of revolution with an axis which is identical with the axis A—A of sliding of the impact shaft 5. A cylindrical ring 92 made of elastomer is force-fitted around the feet 911 and constitutes the brake lining according to the invention.

The braking means 9 also have a needle 93 which is perforated by a conduit 931 in which the cables are accommodated.

The conical head 932 of this needle 93 is accommodated in the cavity 913 formed by the feet 911, thereby abutting against the inclined faces 912. At the opposite end from the head 932, the needle 93 has a thread 933 into which a knurled nut/counter-nut system 94 is screwed.

This nut/counter-nut system 94 makes it possible to keep in place a compression spring 95 whose upper end rests on a washer 96. The washer 96 itself rests on the lower face of the cylindrical ring 92.

At their free end, the cables are kept clamped in a cable clamp 97 via two screws 971, 972.

The functioning of the braking means according to the invention is explained below.

When the user wishes to come to a standstill or reduce the amplitude of the leaps performed, he presses the levers 83, 84, and thus gives rise to tightening of the cables 85, 86 by bringing the cable-clamp 97 into abutment against the knurled nut/counter-nut system 94 (FIG. 2*b*).

This tightening of the cables 85, 86 gives rise to displacement of the needle 93 towards the inside of the cavity 913, with friction of the conical head 932 against the inclined faces 912 and compression of the spring 95 against the washer 96.

The displacement of the needle 93 causes the feet 911 to move apart radially.

The ring 92 is then deformed radially (FIG. 2*b*) and its outer side wall 921 rubs against the inner wall 52 of the impact shaft 5, a fact which gives rise to braking of the latter in relation to the tubular body 2.

Once braking has been achieved, the user releases the levers 83, 84, and thus relieves the cables of tension.

The compression spring 95 returns to the free state and thus brings the needle 93 back into the position it initially occupied before the braking operation.

At the same time, the feet 911 move towards one another again, and the ring returns to its non-deformed state.

Sliding of the impact shaft 5 in relation to the body becomes possible again.

Figure 3:
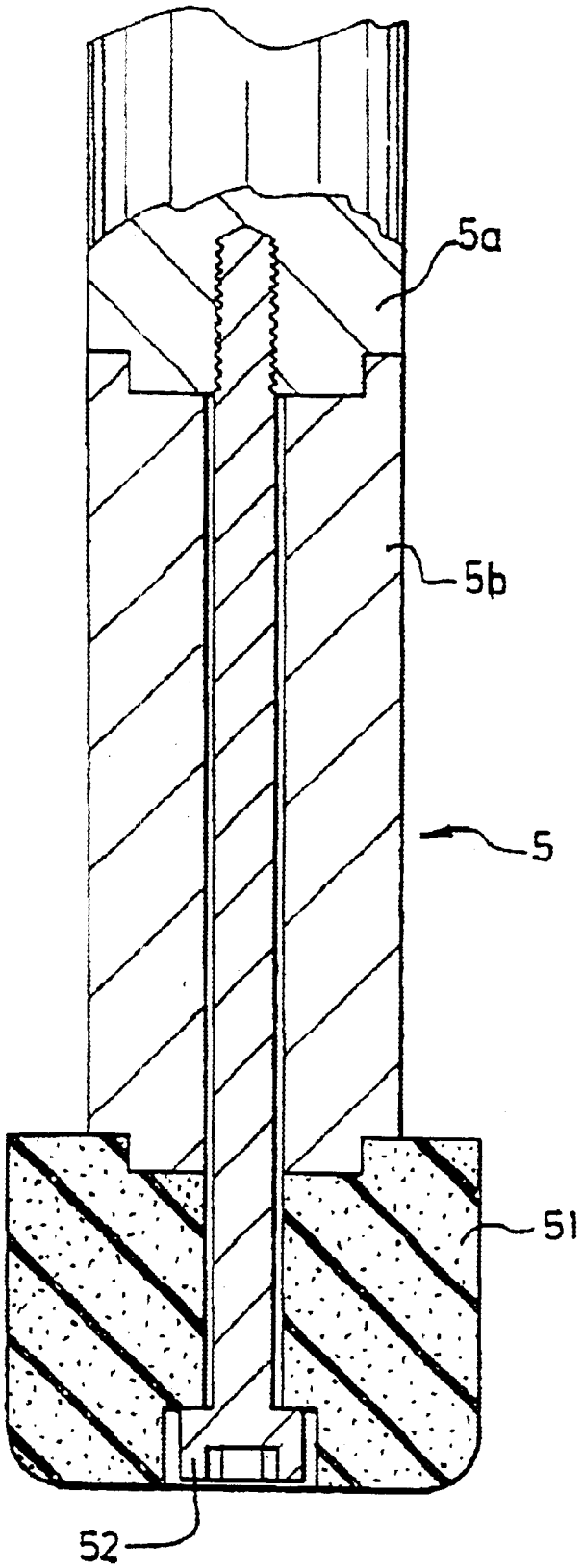
FIG. 3 represents a view in section of a variant of the device according to the invention.

FIG. 3 is a view in section of a variant of the impact shaft 5.

According to this variant, the impact shaft 5 is composed of two parts 5*a*, 5*b* which are interlinked by means of a threaded shaft 52 which also serves to retain the base 5.

The smallest part 5*b* of the impact shaft, which part is disposed in the bottom part of the shaft, may be replaced by any other part of identical shape and different length. The length of this part 5*b* can be adjusted according to the user's height.

Of course, it goes without saying that numerous modifications can be made without thereby departing from the scope of the invention.

Thus, it is entirely possible to replace the particular structure of the braking means 9 described above by an equivalent structure, such as shoes with jaws which are adapted to clamp one or more brake linings arranged in a concentric manner on the outside of the impact shaft 5.

In the same way, the compression spring in the preferred variant, which makes it possible to return the impact shaft, may be arranged in a different manner, such as, for example, disposed around the impact shaft underneath the footrest struts. It may likewise be progressive, a fact which makes it possible to perform the first jumps more easily. It may likewise be replaced by any equivalent means adapted to bring the impact shaft back into its extreme deployed position, such as pneumatic means.

What is claimed is:

1. A device for performing jumps by successive leaps which comprises:

a tubular body having at a lower end footrest struts, a handlebar equipped with grips which is integral with an upper end of the tubular body, an impact shaft which is adapted to slide inside the tubular body and at least part of which is capable of being deployed in the extension of the lower end of the tubular body and means for returning the shaft elastically to an extreme deployed position, means for braking the impact shaft in relation to the body and means, which are disposed on the handlebar, for manually controlling the braking means.

2. A device as claimed in claim 1, wherein the footrest struts are produced in a single, machined piece provided with an axial passage which is adapted to receive the impact shaft by sliding, the machined piece being screwed to the lower end of the tubular body.

3. A device as claimed in claim 1, wherein the handlebar is connected to the upper end of the tubular body via a stem.

4. A device as claimed in claim 1, wherein the elastic returning means comprise a helicoidal spring.

5. A device as claimed in claim 1, wherein the means for manually controlling the braking means are constituted by levers which are mounted on the handlebar and adapted to actuate cables fixed to the braking means.

6. A device as claimed in claim 1, wherein the braking means comprise at least one friction surface which is adapted to rest radially against the impact shaft.

7. A device as claimed in claim 6, wherein the impact shaft is hollow and the friction surface rubs on the inside of the impact shaft.

8. A device as claimed in claim 7, wherein the friction surface is a cylindrical ring made of elastomer.

9. A device as claimed in claim 8, wherein the braking means comprise a bush which is adapted to deform the cylindrical ring radially.

10. A device as claimed in claim 9, wherein the bush has, in its lower part, feet which each have an inclined face and are disposed in a concentric manner and around which the cylindrical ring is force-fitted.

11. A device as claimed in claim 10, wherein a needle having a conical head is inserted between the feet, thereby coming into contact with each inclined face, the manual control means being adapted to displace the needle axially with a view to causing the feet to move apart radially.

12. A device as claimed in claim 11, further comprising means for returning the needle elastically.

13. A device as claimed in claim 5, further comprising a sleeve which is screwed to the upper end of the tubular body and extending longitudinally inside the latter in such a way to accommodate the cables fixed to the braking means.

14. A device as claimed in claim 13, wherein the braking means are fixed to the lower end of the sleeve.

15. A device as claimed in claim 1, further comprising a ball-socket which is adapted to guide the impact shaft along the axis of the tubular body when the impact shaft slides inside the latter.

* * * * *